US007857174B2

(12) United States Patent
Michaux et al.

(10) Patent No.: US 7,857,174 B2
(45) Date of Patent: Dec. 28, 2010

(54) FLUID DISPENSER

(75) Inventors: Sebastien Michaux, Elbeuf (FR); Romain Bertin, Evreux (FR)

(73) Assignee: Valois S.A.S., Le Neubourg (FR)

( * ) Notice: Subject to any disclaimer, the term of this patent is extended or adjusted under 35 U.S.C. 154(b) by 496 days.

(21) Appl. No.: 11/934,959

(22) Filed: Nov. 5, 2007

(65) Prior Publication Data

US 2008/0116232 A1 May 22, 2008

Related U.S. Application Data

(60) Provisional application No. 60/899,001, filed on Feb. 2, 2007.

(30) Foreign Application Priority Data

Nov. 6, 2006 (FR) ..... 06 54737

(51) Int. Cl.
*B67D 3/00* (2006.01)

(52) U.S. Cl. ..... 222/507; 222/321.8; 222/321.9; 222/383.1; 222/402.1; 222/528; 222/530

(58) Field of Classification Search ..... 222/507, 222/505, 508, 321.9, 321.7, 530, 402.1, 538, 222/533–536, 383.1, 182, 383.3, 321.8, 528
See application file for complete search history.

(56) References Cited

U.S. PATENT DOCUMENTS

| | | | | | |
|---|---|---|---|---|---|
| 3,094,255 | A | * | 6/1963 | Hunter | 222/507 |
| 3,276,641 | A | * | 10/1966 | Lehmann | 222/526 |
| 3,371,827 | A | * | 3/1968 | Micallef | 222/507 |
| 4,779,773 | A | * | 10/1988 | Bennett | 222/507 |
| 4,836,423 | A | | 6/1989 | Hayes et al. | |
| 5,016,783 | A | * | 5/1991 | Hayes et al. | 222/153.13 |
| 5,090,601 | A | * | 2/1992 | Thanisch | 222/507 |

FOREIGN PATENT DOCUMENTS

| | | | |
|---|---|---|---|
| EP | 0 890 522 | A | 1/1999 |
| GB | 1 210 875 | A | 11/1970 |

* cited by examiner

*Primary Examiner*—Frederick C. Nicolas
(74) *Attorney, Agent, or Firm*—Sughrue Mion, PLLC

(57) ABSTRACT

A fluid dispenser having: a fluid reservoir, a fluid dispenser member having actuator rod (23) that is displaceable down and up along an axis X, a pusher (4; 4; 4") that displaces the actuator rod (23), a dispenser endpiece (50) defining a dispenser orifice (51), and a displacement mechanism (6, 4; 6', 7; 6", 7, 4") that displaces the endpiece (50) both in turning about the axis X and in radial translation, the radial distance between the endpiece and the axis X varying as the endpiece turns about the axis X, such that the endpiece is displaceable between an extended position remote from the axis X and a retracted position close to the axis X.

13 Claims, 5 Drawing Sheets

FLUID DISPENSER

CROSS REFERENCE TO RELATED APPLICATION

This application claims the benefit under 35 U.S.C. §119 (e) of pending U.S. provisional patent application Ser. No. 60/899,001, filed Feb. 2, 2007, and priority under 35 U.S.C. §119(a)-(d) of French patent application No. FR-06.54737, filed Nov. 6, 2006.

TECHNICAL FIELD

The present invention relates to a fluid dispenser comprising: a reservoir; a dispenser member, such as a pump or a valve; a fastener ring for fastening the pump or the valve on an opening of the reservoir; a pusher that is axially displaceable so as to displace the actuator rod; and a dispenser endpiece defining a dispenser orifice. Such fluid dispensers are commonly used in the fields of perfumery, cosmetics, or even pharmacy.

BACKGROUND OF THE INVENTION

In the field of cosmetics, dispensers are often made with a projecting endpiece, e.g. in the form of a nozzle. The dispenser orifice is situated at the free end of the endpiece or nozzle. By means of the projecting endpiece, it is easier for the user to collect the fluid, especially if it is a viscous fluid, such as a cream, a gel, a pomade, etc. The endpiece is generally mounted in stationary manner on the part to which it is connected. Conventionally, the endpiece is mounted on the pusher that is axially displaceable. In a variant, it is also possible to mount the endpiece on a part that is independent of the pusher and that is stationary relative to the reservoir. In order to protect the endpiece, it is also known to provide it with a cap, making it possible to mask the dispenser orifice in such a manner that the fluid situated in the dispenser orifice is no longer in contact with the air. It is thus possible to avoid deterioration of the fluid in the dispenser orifice. However, this requires the user to remove the cap and put it back into place each time the dispenser is used. There is also a risk of losing the cap.

BRIEF SUMMARY OF THE INVENTION

An object of the present invention is to protect the dispenser endpiece by making it movable relative to the part from which it projects, in such a manner as to be able to retract it.

To do this, the present invention proposes a fluid dispenser comprising: a fluid reservoir provided with an opening; a fluid dispenser member, such as a pump or a valve, said member comprising a body and an actuator rod that is displaceable down and up along an axis X; a fastener ring for fastening the dispenser member on the opening of the reservoir; a pusher that is axially displaceable down and up so as to displace the actuator rod; and a dispenser endpiece defining a dispenser orifice; the fluid dispenser being characterized in that it further comprises displacement means that are suitable for displacing the endpiece both in turning about the axis X and in radial translation, the radial distance between the endpiece and the axis X varying as the endpiece turns about said axis X, such that the endpiece is displaceable between an extended position remote from the axis X and a retracted position close to the axis X. Thus, the dispenser endpiece is retracted radially as it is turned. In other words, it is the turning of the dispenser endpiece that causes the endpiece to be displaced radially inwards or outwards depending on the turning direction. The endpiece thus follows a complex path that is substantially helical.

In an advantageous embodiment, the displacement means comprise: a rotary actuator member that turns about the axis X, the endpiece being constrained to turn with said actuator member; and a cam path that is prevented from turning relative to the reservoir; the radial distance between the path and the axis X varying along the path, the endpiece being engaged with the cam path in such a manner that it follows the cam path while it is being turned by the actuator member. Thus, it is the turning of the actuator member that forces the dispenser endpiece to be displaced along the cam path, which is itself prevented from turning relative to the actuator member or relative to the reservoir.

In another embodiment, the cam path is formed by a cam element that is mounted on a ferrule that is mounted in stationary manner relative to the reservoir, the cam element being prevented from turning relative to the ferrule, but being capable of being displaced axially, the pusher being in engagement with the ferrule via a second threaded cam path, the pusher being turned by the actuator member, the pusher being displaced axially relative to the ferrule and to the actuator member by following the second threaded cam path while said pusher is being turned by the actuator member, such that turning the actuator member simultaneously causes both the rotary axial displacement of the pusher and the rotary radial displacement of the endpiece. In this event, the pusher is displaced axially as it turns, and simultaneously the dispenser endpiece is displaced radially as it turns. The pusher and the endpiece are turned simultaneously. A dispenser is thus created having an actuator member that both causes the pusher to rise and the endpiece to be extended out therefrom. By turning the actuator member in the opposite direction, the pusher descends, and simultaneously the endpiece retracts radially. Advantageously, the pusher is axially displaceable in such a manner as to be housed entirely in the actuator member with the endpiece in its retracted position, that is masked by the actuator member. In this way, not only is the endpiece retracted in its housing, but the housing is also covered by the actuator member. In another characteristic, the pusher comprises a body and a cover, the body forming a rotary housing for the endpiece, the cam path being disposed between the body and the cover. The cam path is thus held captive in the pusher, while enabling the pusher and the cam path to turn relative to each other.

In an advantageous characteristic of the invention, the endpiece is connected to the actuator rod via a flexible hose. The hose makes it possible to interconnect, with a considerable degree of freedom, the end of the actuator rod of the dispenser member and the dispenser endpiece that is displaced simultaneously in turning and in radial translation. The end of the hose that is connected to the dispenser endpiece must follow a path that is substantially or partially helical. Consequently, it is necessary for the hose to present good deformability characteristics without kinking.

In an embodiment, the cam path is axially displaceable down and up with the pusher. In a variant, the cam path is stationary relative to the reservoir. In this event, the dispenser endpiece is not mounted on the pusher. In another aspect of the invention, the pusher forms the rotary actuator member, the endpiece being constrained to turn with the pusher. In this event, it is the pusher that the user turns so as to force the endpiece to follow the cam path. It is even possible to say that the pusher and the rotary actuator member are the same member. In a variant, the endpiece is constrained to turn with the pusher, the pusher being turned by the rotary actuator member which is a part that is distinct from the pusher, the actuator member being prevented from moving in axial translation. In this event, the actuator member and the pusher are separate parts, the pusher being capable of being displaced axially relative to the actuator member that remains stationary relative to the reservoir. In contrast, the actuator member may be turned.

In another aspect of the invention that is advantageous, the endpiece is disposed in a rotary housing in which it is displaceable radially. The endpiece is held captive in the rotary housing, but it is forced to slide inside the housing since it is constrained to follow the cam path.

In an embodiment of the invention, the cam path is formed by a cam element that is mounted on the fastener ring. The cam element is thus in engagement with the fastener ring in such a manner as to prevent said cam element from turning, the cam element optionally being capable of being displaced axially relative to the ring.

In another aspect of the invention, the cam path is formed by a cam element comprising a plate that is provided with a rib defining the cam path, the endpiece including a groove in which the rib is slidably housed.

In another advantageous aspect of the invention, the pusher includes a window through which the cam element is visible. Given that the cam element is prevented from turning relative to the reservoir, it remains stationary in turning even if the pusher is rotary. In this way, it is possible to provide the cam element with any marking, such as a logo or a trademark, for example, that is not going to be turned. Thus, the logo or the trademark is always oriented correctly relative to the front face of the reservoir, for example.

An advantageous principle of the invention lies in the dispenser endpiece being displaced radially: to do this, an actuation movement is generated that causes the endpiece to be displaced radially. The actuation movement can be a rotary movement or some other movement, e.g. an axial movement.

BRIEF DESCRIPTION OF THE DRAWINGS

The invention is described more fully below with reference to the accompanying drawings which show three embodiments of the invention by way of non-limiting example.

In the figures.

DETAILED DESCRIPTION

Figure 1:
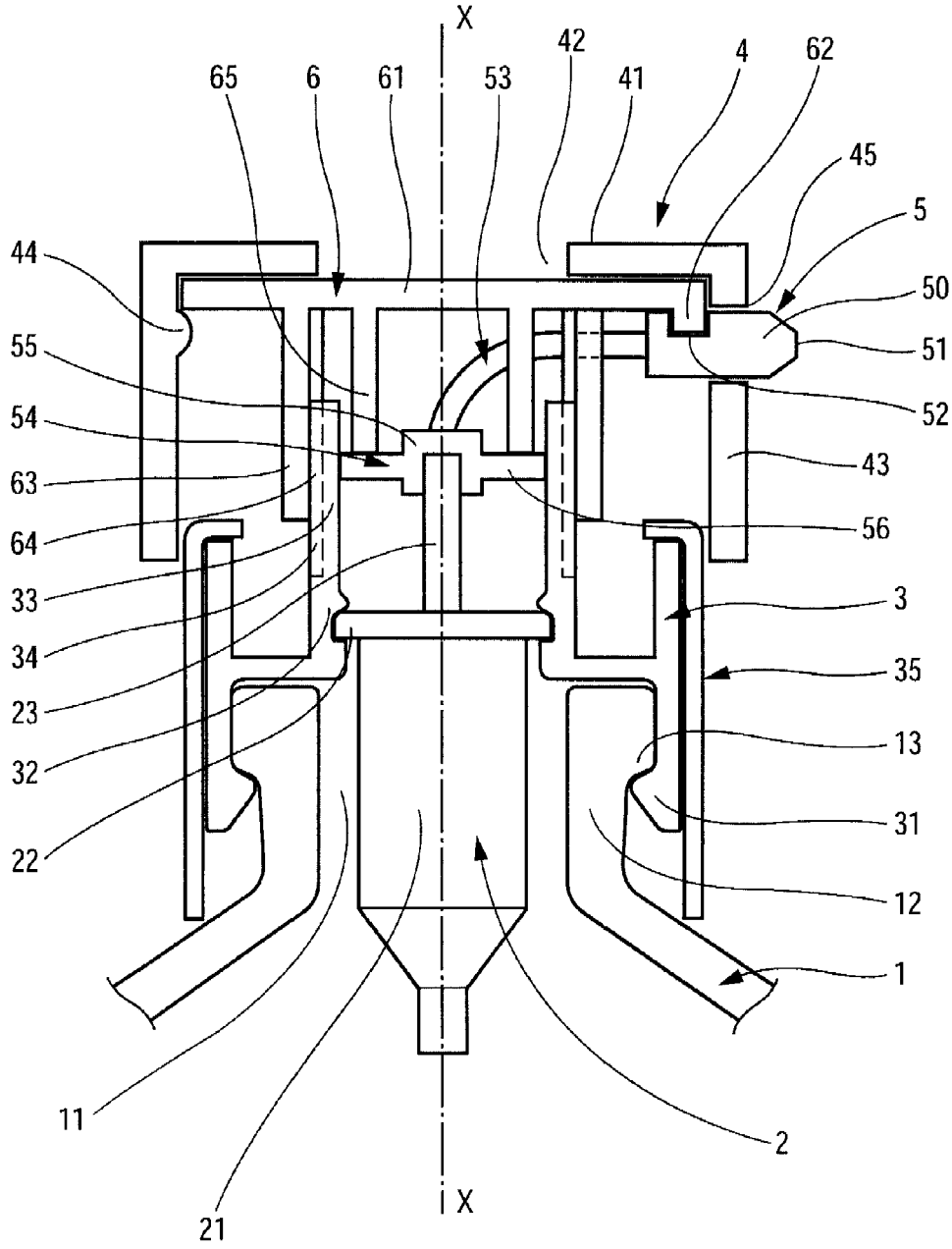
FIG. 1 is a diagrammatic vertical-section view through a fluid dispenser constituting a first embodiment of the invention.
Figure 2A:
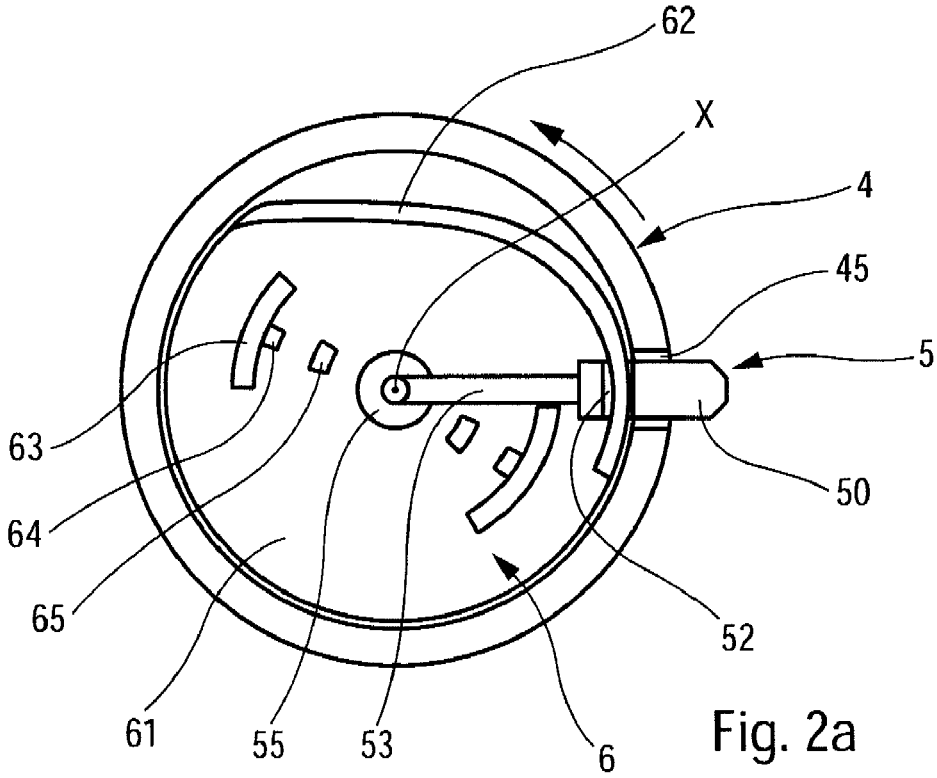
FIGS. 2*a* and 2*b* are diagrammatic horizontal cross-section views through the FIG. 1 dispenser, with the dispenser endpiece in its extended position and in its retracted position.
Figure 2B:
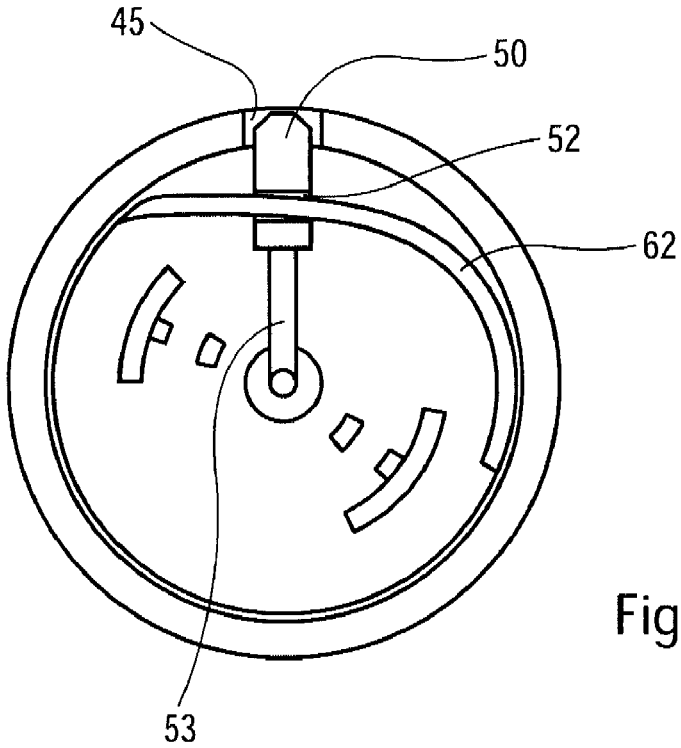

Reference is made firstly to FIGS. 1, 2*a*, and 2*b* in order to describe in detail the structure and the operation of a fluid dispenser constituting a first embodiment of the invention. The dispenser comprises six component elements, namely: a fluid reservoir 1; a dispenser member 2, which can be a pump or a valve; a fastener ring 3 for fastening the pump or the valve on the receptacle; a pusher 4 on which the user can press so as to actuate the pump or the valve; a dispenser part 5; and a cam element 6. Most of these elements can be made by injection-molding plastics material.

The reservoir 1 comprises a reservoir body (not shown) which is terminated at its top end by a neck 12 defining an opening 11, putting the inside of the reservoir into communication with the outside. The neck 12 includes an annular shoulder 13 that is directed downwards. The shoulder is formed by annular reinforcement that projects radially outwards. This is a fairly conventional design for a reservoir in the fields of perfumery, cosmetics, or even pharmacy. The reservoir can be made of glass, of plastics material, or of metal.

In this embodiment, the dispenser member is a pump. It comprises a pump body 21 which forms a fastener collar 22 at its top end. The pump also comprises an actuator rod that is axially displaceable down and up along an axis X. In the rest position shown in FIG. 1, the actuator rod is extended maximally upwards by an internal spring (not shown) housed inside the body 21. The actuator rod can be driven inside the body against the spring so as to reach a maximally depressed position. This is a fairly conventional pump in the above-mentioned technical fields.

The fastener ring 3 includes fastener means 31 for coming into engagement below the annular shoulder 13 of the neck 12 of the reservoir. By way of example, the fastener means 31 can be in the form of a fastener head or in the form of a continuous annular bead that is suitable for being housed below the shoulder 13. The ring can optionally be provided with an outer covering 35. In addition, the fastener ring 3 forms a reception housing 32 in which the collar 22 of the pump body 21 is received, advantageously by snap-fastening. Above the housing 32, the ring forms a sleeve 33 having an outer wall that includes grooves 34. The grooves 34 extend over all or part of the height of the sleeve 33 and are open upwards. Instead of the fastener bead or heads, it is possible to provide a thread that is adapted to be screwed onto a reservoir neck that is tapped.

The dispenser part 5 is built up from a plurality of pieces, however it could be made as a single piece. The part 5 includes a dispenser endpiece 50 which forms a dispenser orifice 51 through which the fluid that is dispensed by the dispenser leaves so that it can be collected by the user. In addition, the part 5 includes a connection sleeve 55 that is mounted in stationary manner on the free top end of the actuator rod 23. The sleeve 55 is provided with two bearing fins 54 that extend on either side of the sleeve 55. Furthermore, the part 5 includes a flexible hose 53 that interconnects the sleeve 55 and the dispenser endpiece 50. Thus, the fluid that is driven by the pump through the actuator rod 23 can flow through the hose 53 so as to reach the endpiece 50 from which it is dispensed through the dispenser orifice 51. In the invention, the endpiece 50 is provided with a guide groove 52 that extends substantially perpendicularly to the axis of the dispenser orifice 51. The part 5 can be made as a single piece by overmolding the hose 53 on the sleeve 55 and on the endpiece 50. A flexible material is preferably used for the hose 53 so as to guarantee a large degree of freedom between the sleeve 55 and the endpiece 50.

The pusher 4 includes a bearing surface 41 on which the user can press by means of one or more fingers. The bearing surface 41 is formed with a window 42. Furthermore, the pusher includes a lateral skirt 43 that is of substantially cylindrical shape. Internally, the skirt 43 forms a snap-fastener bead 44 close to its bearing surface 41. The skirt 43 also forms a side opening that serves as a housing 45 for slidably receiving the endpiece 50. In FIG. 1, the endpiece 50 can be seen engaged through the housing 45. The pusher 4 can be turned manually about the axis X relative to the pump 2, the fastener ring, or the reservoir. In the invention, the pusher 4 serves as a rotary actuator member for the cam element 6.

The cam element 6 comprises a top plate 61, which, over at least a fraction of its periphery, is provided with a rib 62 that projects downwards. The rib extends along a non-circular path in such a manner that the distance between the rib 62 and the axis X varies along the rib 62. In the invention, the rib serves as a cam path for the endpiece 50. It can be seen in FIG. 1 that the rib 62 is engaged inside the groove 52 formed by the endpiece 50. Thus, it should be easily understood that the endpiece 50 is displaced radially inwards or outwards as its groove 52 is displaced along the rib 62. This is clearly visible in FIGS. 2*a* and 2*b*. Thus, in order to displace the endpiece 50 along the cam path 62, it suffices to turn the pusher 4 about the axis X. Given that the endpiece 50 is engaged in the housing 45, said endpiece is constrained to turn as with the pusher, while also being constrained to follow the cam path as a result of its groove 52 being engaged on the path. The endpiece 50 is thus subjected to turning combined with a radial displacement, in such a manner as to describe a path that is substantially helical. This is clearly visible by comparing FIGS. 2*a* and 2*b*. FIG. 2*a* corresponds to the position shown in FIG. 1. This is the dispensing position in which the user can press on the pusher so as to dispense a dose of fluid. The endpiece 50 thus projects out from the housing 45. The cam path 62 is situated close to the housing 45. Its distance from the axis X is thus at a maximum. By turning the pusher 4 in the direction of the arrow shown in FIG. 2*a*, the endpiece 50 that is engaged in the housing 45 turns with the pusher, while it is also displaced along the cam path 62 so as to come into the position in FIG. 2*b*. This is the rest position in which the dispenser can be stored. The endpiece 50 no longer projects out from the housing 45, and the cam path 62 is thus remote from the housing 45. The distance between the cam path and the axis X is thus at a minimum. In order to enable the endpiece 50 to perform such combined displacement, it should be understood that the pusher is free to turn, while the cam element 6 is prevented from turning. To do this, the cam element 6 includes a plurality of tabs 63 that are provided with splines 64 engaged in the grooves 34 of the sleeve 33 of the fastener ring. Engaging the splines 64 in the grooves 34 prevents the cam element 6 from turning relative to the ring 3, while enabling the cam element 6 to be displaced axially along the axis X. In addition, during axial displacement, it is also necessary for the cam element 6 to be secured to the pusher 4. To do this, the peripheral edge of the plate 61 is engaged locally behind the internal bead 44 formed by the skirt 43 of the pusher. Although the pusher 4 is free to turn about the plate 61, it entrains the plate while the pusher is being displaced axially. Finally, in order to transmit the force from the pusher to the actuator rod, the cam element 6 includes two thrust prongs 65 that come into engagement with the fins 56 of the dispenser part 5. Thus, the pusher 4 can turn about the cam element 6 that is prevented from turning relative to the ring 3, but that is not prevented from moving in axial translation relative thereto. By pressing on the pusher 4, the cam element 6 bears, via the prongs 65 and the fins 56, against the actuator rod 34 so as to actuate the pump 2.

It should be observed that while the dispenser is being actuated, consisting in axially displacing the pusher 4, the hose 53 is not deformed. In contrast, while the pusher 4 is being turned, the hose 53 deforms so as to follow the combined turning and radial translation movement of the endpiece 50.

In the first embodiment, the dispenser endpiece 50 is constrained to turn with the pusher 4 which acts as a rotary actuator member. The cam element 6 is prevented from turning on the ring 3, but it is displaced axially along the axis X together with the pusher 4. However, this is merely one non-limiting embodiment, as can be seen below.

Figure 3:
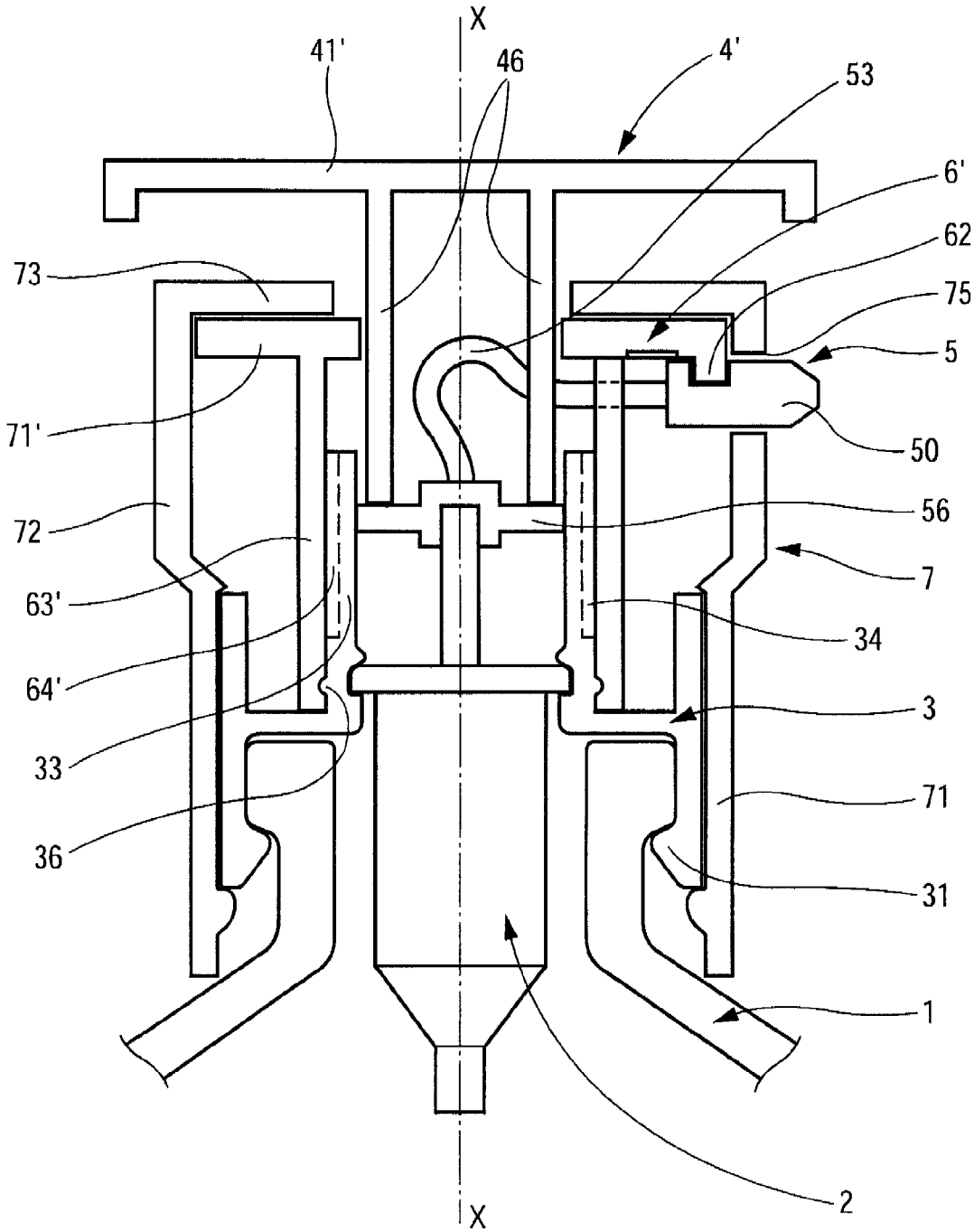
FIG. 3 is a vertical-section view through a fluid dispenser constituting a second embodiment of the invention.

Reference is made below to FIG. 3 in order to describe a second embodiment of the invention. The reservoir 1, the dispenser member 2, and the dispenser part 5 can be substantially similar or identical to those of the first embodiment. The fastener ring 3 likewise includes fastener means 31 for fastening on the reservoir neck, and a receiver housing for receiving the pump. The ring 3 likewise forms a sleeve 33 that is provided externally with vertical grooves 34. The ring 3 further includes a snap-fastener bead 35.

The pusher 4' includes a bearing surface 41', and a plurality of bearing prongs 46 that come to bear against the fins 56 of the dispenser part 5. The pusher 4' need not be free to turn.

The cam element 6' includes a plate 61' which forms a cam path, just as in the first embodiment. The cam element likewise includes anchor tabs 63' formed with inner splines 64' engaged in the grooves 34 of the sleeve 33. At their bottom ends, the tabs 63' are snap-fastened on the bead 35. Thus, the cam element 6' is mounted stationary on the fastener ring 3, being prevented from turning or moving axially relative thereto. It can even be envisaged to make the cam element 6' and the ring 3 as a single piece.

In this embodiment, the dispenser further includes a rotary actuator member 7 that is distinct from the pusher 4' and from the cam element 6'. The actuator member 7 includes a sleeve 71 that is engaged in rotary manner around the fastener ring 3. Above the sleeve 71, the actuator member 7 forms a section in which there is formed a housing 75 for providing guidance in sliding. The endpiece 50 is slidably engaged inside the housing 75. The actuator member 7 also forms an annular plate 73 that is formed with a central opening through which the bearing tabs 46 of the pusher 4' pass. The cam element 6' is housed inside the rotary actuator member 7 which simultaneously provides a covering function for the dispenser, masking the cam element 6' and the fastener ring 3.

Thus, by turning the actuator member 7 about the axis X, the dispenser endpiece 50 is turned, but said dispenser endpiece is constrained to follow the cam path 62 formed by the cam element 6, as in the first embodiment. The cam element 6' and the pusher 4' remain stationary while the actuator member 7 is being turned. Then, by pressing on the pusher 4', the pump 2 is actuated and fluid is dispensed through the dispenser endpiece 50, which itself remains stationary, since it is mounted on the actuator member 7 that is not axially displaceable. In contrast to the first embodiment in which the hose 53 is not deformed while the dispenser is being actuated, in this second embodiment, the hose 53 is deformed while the dispenser is being actuated since the actuator rod is displaced axially, while the dispenser endpiece 50 remains stationary.

In this second embodiment, it should be observed that the actuator member is distinct from the pusher, and that the cam element 6' is not displaced axially. However, turning the actuator member 7 relative to the cam element 6' makes it possible to displace the dispenser endpiece 50 along a substantially helical path, resulting in a combined rotary and radial displacement.

Figure 4:
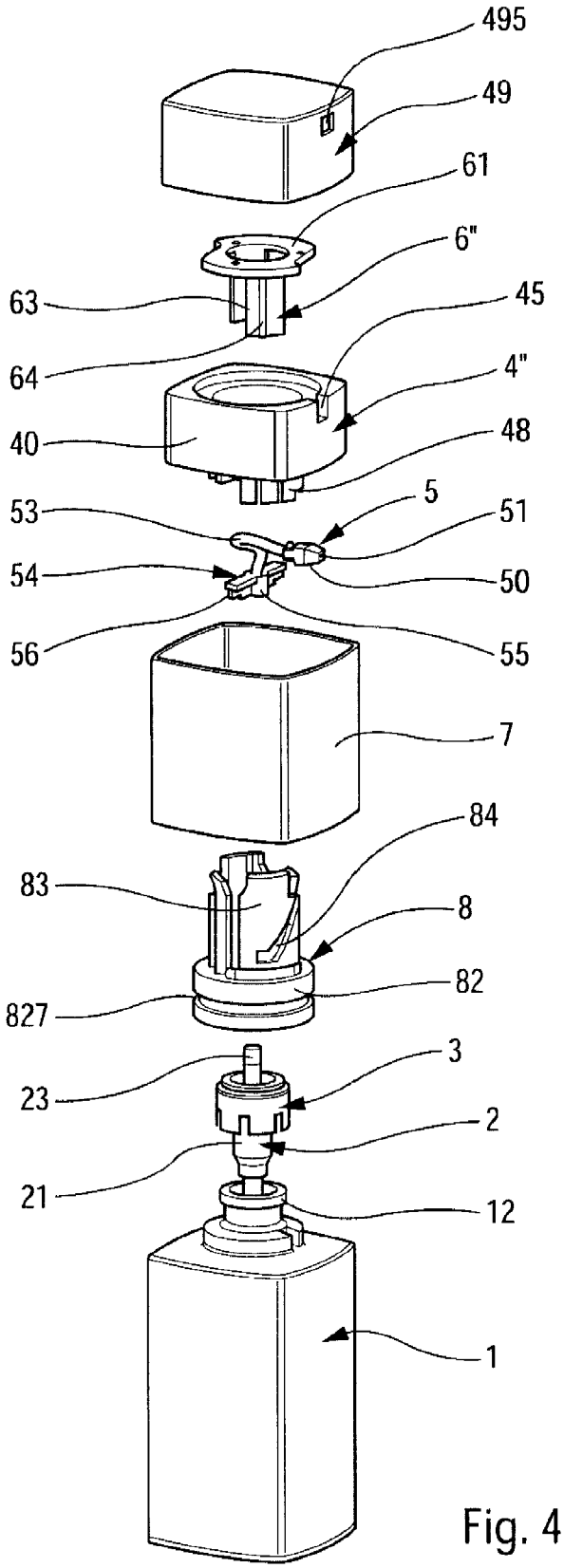
FIG. 4 is an exploded perspective view of a fluid dispenser constituting a third embodiment of the invention.
Figure 5B:
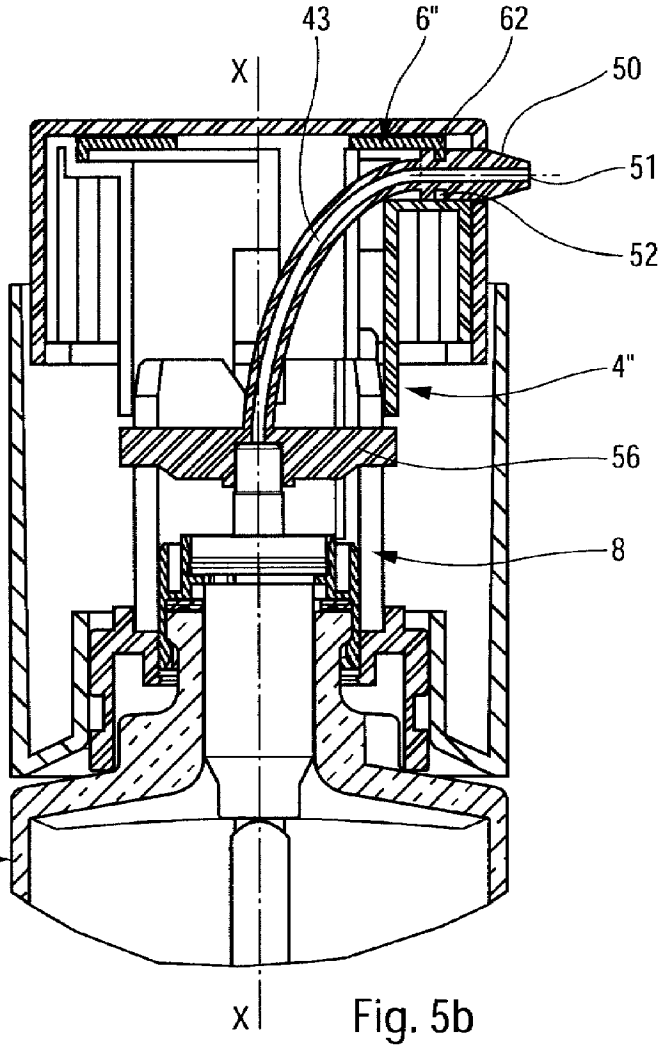
FIGS. 5*a* and 5*b* are vertical-section views through the FIG. 4 dispenser in the retracted position and in the extended position of use.
Figure 5A:
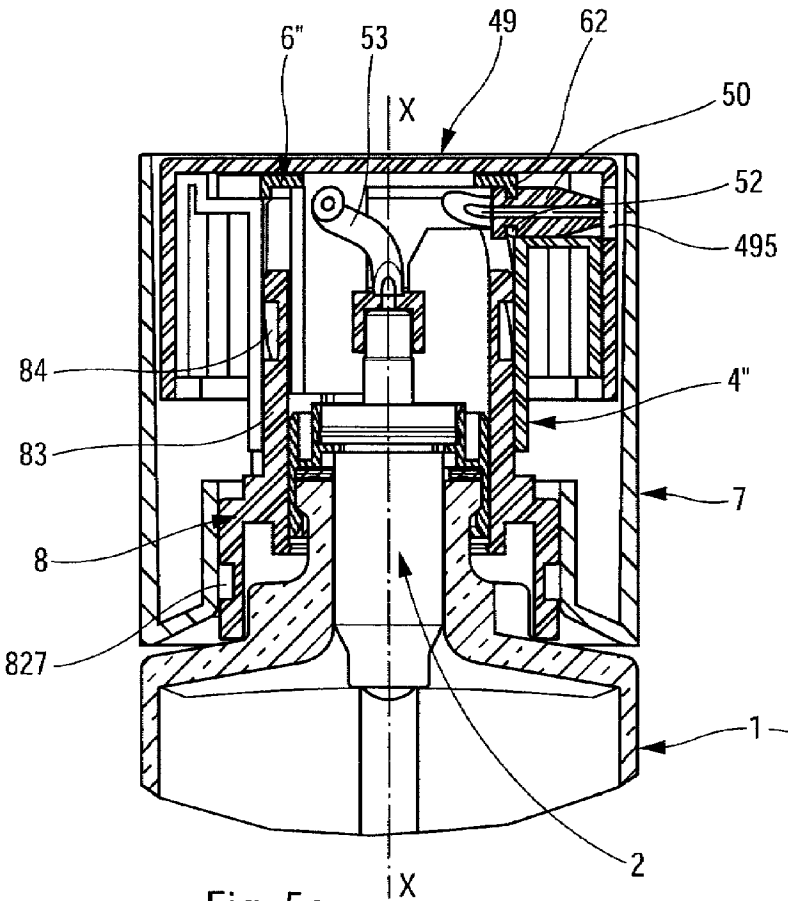

Reference is made below to FIGS. 4, 5*a*, and 5*b* in order to describe a more complex third embodiment of the invention. The dispenser comprises eight component elements, namely: a reservoir 1; a pump 2; a fastener ring 3; a ferrule 8, a rotary actuator member 7; a dispenser part 5; a pusher 4" constituted by a body 40 and by a cover 49; and a cam element 6".

The reservoir 1 includes a neck 12 in which the pump 2 is engaged. The fastener ring 3 makes it possible to fasten the pump 2 on the neck 12 in leaktight manner. The ferrule 8 is mounted stationary, both in turning and in axial displacement, on the ring 3 or on the reservoir 1. The ferrule 8 includes a base 82 forming a slide groove 827. Above the base 82, the ferrule 8 includes a bushing 83 that externally defines a second cam path 84, and that internally defines axial guide grooves (not shown). The second cam path 84 comprises a helical portion in the form of a screw thread, and an axial vertical portion that is connected to the helical portion. The bushing includes two cam paths 84 of this type. They are formed on the outer wall of the bushing 83.

The dispenser part 5 can be substantially similar or identical to those in the first two embodiments. The connection sleeve 55 is engaged on the free end of the actuator rod 23. The endpiece 50 is connected to the sleeve 55 via a flexible hose 53. Two bearing fins or arms 56 extend on either side of the sleeve 55. The rotary actuator member 7 is engaged around the ferrule 8 and forms one or more profile(s) (not shown) that are engaged in the peripheral groove 827. Thus, the actuator member 7 is secured to the ferrule 8 while being capable of turning about its own axis, about the ferrule 8. The actuator member 7 is not axially displaceable. The actuator member 7 presents a polygonal cross-section that is advantageously substantially square.

The pusher 4" includes a body 40 forming a housing 45 in which the endpiece 50 is slidably received. In addition, the body 40 forms branches 48, each provided with a cam lug for coming into engagement in the second cam path 84 formed by the ferrule 8. The body 40 presents a cross-section of polygonal shape, advantageously substantially square, having dimensions that enable it to be engaged inside the actuator member 7. Thus, turning the actuator member 7 causes the body 40 of the pusher 4" to turn. However, as a result of the body 40 being engaged on the second cam path 84, said body is constrained to be displaced axially as the cam lugs are displaced in the helical portions of the cam path 84. By turning the actuator member counterclockwise from the low position, the pusher is displaced axially upwards, turning about its own axis. Once they reach the top of the helical portion of the second cam path, the lugs can be displaced axially in the axial vertical portions of the cam paths. Consequently, the pusher can be displaced axially so as to press on the bearing fins or arms 56 of the dispenser part 5. This position is shown in FIG. 5*b*.

In addition, the cam element 6" includes a top plate 61 that defines a rib 62 that serves as a cam path, as in the first two embodiments. Furthermore, the cam element 6" includes two tabs 63 that are provided with axial guide splines engaged in grooves formed inside the bushing 83. As a result, the cam element 6" can be displaced axially relative to the ferrule 8, but it is prevented from turning relative to said same ferrule. The tabs 63 of the cam element 6" extend through the body 40 of the pusher 4". More precisely, the branches 48 of the body 40 extend outside the bushing 83, whereas the tabs 63 of the cam element 6" extend inside the bushing 83.

Finally, the pusher 4" also includes a cover 49 forming an opening 495. The cover 49 is mounted on the body 40 in such a manner that the opening 495 is in alignment with the housing 45 in which the body 40 is slidably received. The plate 61 of the cam element 6" is disposed between the body 40 and the cover 49, and is thus held captive in the pusher, while enabling the cam element 6" and the pusher 4" to turn relative to each other.

As in the first two embodiments, the rib 62, acting as a cam path, extends along a non-circular path in such a manner that the distance between the rib and the turning axis of the dispenser varies along the cam path. As can be seen in FIGS. 5*a* and 5*b*, the cam path 62 is engaged in a groove 52 formed in the dispenser endpiece 50. In addition, the endpiece 50 is slidably engaged in the housing 45 of the body 40. Thus, by causing the actuator member 7 to turn about its own axis (without axial displacement), this results in two simultaneous displacements. The first displacement is the displacement of the pusher 4" that is constrained to be displaced axially as a result of its co-operation with the second helical cam path 84 of the ferrule 8. The second movement is the movement of the dispenser endpiece 51 that is constrained to be displaced radially as a result of it following the cam path 62 that moves closer to the turning axis X of the dispenser. Consequently, by turning the actuator member 7, the pusher 4" rises and turns, and the dispenser endpiece turns and is displaced radially. In the rest and storage position shown in FIG. 5*a*, the endpiece 50 is completely retracted inside the pusher 4" and the opening 495 is even covered by the actuator member 7. The pusher 4" is in its low position. From this position, by turning the actuator member 7, the pusher 4" turns with the actuator member 7 and simultaneously is displaced axially upwards. Simultaneously, the endpiece 50, that is constrained to turn with the housing 45 formed by the pusher, is turned, and is also displaced radially outwards by the cam path 62. In its high position, the configuration shown in FIG. 5*b* is reached, in which the dispenser endpiece 50 projects out from the housing 45. During these combined displacements of the pusher and of the endpiece, the hose 53, at its connection to the endpiece 50, is displaced not only in turning, but also in axial translation. This is why it is necessary for the hose 53 to be particularly flexible. This can be achieved only by overmolding the hose on the connection sleeve and on the dispenser endpiece 50.

In this third embodiment, the pusher is distinct from the rotary actuator member, and the endpiece 50 is mounted on the pusher. The cam element is prevented from turning, but is displaceable in axial translation. The actuator member is rotary, but is prevented from moving in axial translation.

From the three embodiments of the invention, it can be seen that it is possible to displace the dispenser endpiece 51 radially, by causing it to turn simultaneously.

The invention claimed is:

1. A fluid dispenser comprising:

a fluid reservoir (1) provided with an opening (11);

a fluid dispenser member (2) comprising a body (21) and an actuator rod (23) that is displaceable down and up along an axis X;

a fastener ring (3) for fastening the dispenser member on the opening of the reservoir;

a pusher (4; 4; 4") that is axially displaceable down and up so as to displace the actuator rod (23); and a dispenser endpiece (50) defining a dispenser orifice (51);

displacement means (6, 4; 6', 7; 6", 7, 4") that are suitable for displacing the endpiece (50) both in turning about the axis X and in radial translation, the radial distance between the endpiece and the axis X varying as the endpiece turns about said axis X, such that the endpiece is displaceable between an extended position remote from the axis X and a retracted position close to the axis X, the displacement means comprising a rotary actuator member (4; 7) that turns about the axis X, the endpiece (50) being constrained to turn with said actuator member, and a cam path (62) that is prevented from turning relative to the reservoir (1), the radial distance between the path (62) and the axis X varying along the path, the endpiece (50) being engaged with the cam path in such a manner that it the endpiece follows the cam path while the endpiece is being turned by the actuator member (4; 7), the cam path (62) is formed by a cam element (6") that is mounted on a ferrule (8) that is mounted in stationary manner relative to the reservoir (1), the cam element (6") being prevented from turning relative to the ferrule (8), but being capable of being displaced axially, the pusher (4") being in engagement with the ferrule (8) via a second threaded cam path (84), the pusher (4") being turned by the actuator member (7), the pusher (4") being displaced axially relative to the ferrule (8) and to the actuator member (7) by following the second threaded cam path (84) while said pusher is being turned by the actuator member, such that turning the actuator member simultaneously causes the rotary axial displacement of the pusher and the rotary radial displacement of the endpiece.

2. A dispenser according to claim 1, in which the endpiece (50) is connected to the actuator rod (23) via a flexible hose (53).

3. A dispenser according to claim 1, in which the cam path (62) is axially displaceable down and up with the pusher (4; 4").

4. A dispenser according to claim 1, in which the cam path (62) is stationary relative to the reservoir (1).

5. A dispenser according to claim 1, in which the pusher (4) forms the rotary actuator member, the endpiece (50) being constrained to turn with the pusher.

6. A dispenser according to claim 1, in which the endpiece (50) is constrained to turn with the pusher (4"), the pusher being turned by the rotary actuator member (7) which is a part that is distinct from the pusher, the actuator member being prevented from moving in axial translation.

7. A dispenser according to claim 1, in which the endpiece (50) is disposed in a rotary housing (45; 75) in which it is displaceable radially.

8. A dispenser according to claim 1, in which the cam path (62) is formed by a cam element (6; 6") that is mounted on the fastener ring.

9. A dispenser according to claim 1, in which the pusher (4") is axially displaceable in such a manner as to be housed entirely in the actuator member (7) with the endpiece (50) in its retracted position, that is masked by the actuator member.

10. A dispenser according to claim 1, in which the pusher (4") comprises a body (40) and a cover (49), the body (40) forming a rotary housing (45) for the endpiece (50), the cam path (62) being disposed between the body and the cover.

11. A dispenser according to claim 1, in which the cam path (62) is formed by a cam element (6; 6; 6") comprising a plate (61) provided with a rib defining the cam path, the endpiece (50) including a groove (52) in which the rib is slidably housed.

12. A dispenser according to claim 1, in which the pusher (4) includes a window (42) through which the cam element (6) is visible.

13. A dispenser according to claim 1, in which fluid dispenser member is a pump or a valve.

* * * * *